United States Patent [19]

Rahlwes et al.

[11] Patent Number: 4,486,991

[45] Date of Patent: Dec. 11, 1984

[54] TIE-ANCHOR FOR REINFORCING CABLE

[76] Inventors: Kurt Rahlwes, Rossertstr. 8, D-6374 Steinbach; Wolfram Illgner, Kettelerstr. 29a, D-6360 Friedberg; Dieter Reimann, Grosse Bockenheimer Str. 17, D-6000 Frankfurt/Main, all of Fed. Rep. of Germany

[21] Appl. No.: 226,578

[22] Filed: Jan. 21, 1981

Related U.S. Application Data

[63] Continuation of Ser. No. 036,312, May 7, 1979, abandoned.

[51] Int. Cl.[3] ..... E04C 3/10

[52] U.S. Cl. ..... 52/223 L; 52/230; 24/122.6

[58] Field of Search ..... 52/223 L, 230, 697; 24/122.6, 115 A

[56] References Cited

U.S. PATENT DOCUMENTS

| | | | |
|---|---|---|---|
| 3,820,832 | 6/1974 | Brandestini et al. | 52/230 X |
| 4,295,250 | 10/1981 | Dupuy | 24/122.6 |

FOREIGN PATENT DOCUMENTS

| | | | |
|---|---|---|---|
| 965836 | 6/1957 | Fed. Rep. of Germany | 52/230 |
| 1115054 | 4/1956 | France | 52/230 |
| 408370 | 9/1966 | Switzerland | 52/230 |
| 777318 | 6/1957 | United Kingdom | 264/228 |

*Primary Examiner*—Carl D. Friedman

*Attorney, Agent, or Firm*—Lackenbach, Siegel, Marzullo, Presta & Aronson

[57] ABSTRACT

A wire cable is unravelled at one end wherein the unravelled individual wire strands are formed into a pear-shaped construction whereby concrete is formed within and without the pear-shaped configuration so as to form a tie-anchor thereof. The invention relates to the process and apparatus for forming the tie-anchor as well. The pear-shaped configuration as formed provides improved tie anchor within a minimum of feed length of cable required to form same, while eliminating the need for costly anchor plates and keys.

6 Claims, 6 Drawing Figures

TIE-ANCHOR FOR REINFORCING CABLE

This is a continuation of application Ser. No. 036,312 filed May 7, 1979, abandoned.

FIELD OF INVENTION

The invention relates to a tie-anchor formed at a strand or cable, made out of a plurality of steel wires, through spreading apart of and accompanied by plastic deformation of the wires, by means of which tie-anchor, the strand can be anchored in concrete or similar settable material. The invention relates moreover to a process for the manufacture of such a tie-anchor as well as to a device for the carrying into effect of the process.

BACKGROUND AND DISCUSSION OF PRIOR ART

Strands or cables made of plurality of high-grade interwined steel wires are frequently used in prestressing of concrete structures, on account of their elevated bearing capacity accompanied by ease of handling. The anchoring of the strands to the concrete is brought about either by means of round keys in an anchoring plate or by making use of the bond. To transfer the tension load from the strand or cable to the concrete by bonding, one requires a greater transfer length. Upon embedding of the undeformed strand or cable, the required feed length is frequently not available; in such instances, anchoring must be brought about by costly anchoring plates and round keys. Besides, a short transfer length provides also the advantage of savings of costly strand. Since, frequently, a large number of strands comes to be anchored in a concrete structure, it must be possible to perform quickly and simply the measures resulting in a shortening of the feed length. Any reduction of the feed length results necessarily in an increase of the cleavage forces in the concrete. The bonding aids used must not bring about any excessive increase of the cleavage forces since, otherwise, additional reinforcement steels are required to prevent a cracking of the concrete. Moreover, the mechanical properties of the strand must not be significantly impaired by the anchoring measures.

Various measures are known that are designed to achieve an improved bond of the strand; e.g. in the publication "Betonwerk and Fertigteil-Technik", No. 6/76, there is described a so-called "bulb-type anchoring". In that case, the strand is untwisted by fanning it out and an attachment is inserted as a result of which there is brought about a local thickening of the strand accompanied by elastic deformation of the wires. This is a labor-intensive procedure. In order to render the bulb-type anchoring effective, it is in addition necessary that, downstream of or extending behind the bulb, there should still be available a certain length of strand that has not been untwined. That projection of strand increases the anchor length.

The affixing of shafts, loops, and hooks customarily used for the anchoring of steel rods does not bring about a reliable and efficient anchoring of the strands in view of the fact that, in those cases, the core wires of the strand do not come in direct contact with the concrete. In the case of the prestressing method accompanied by subsequent bonding, there are known in the art loop-type anchors in which the strands, coming from a sleeve, are guided within the concrete to form a loop and are then reinserted into the sleeve. It is however difficult to produce such loops. Frequently, it is even necessary to reduce the bearing pressure of the strands on the concrete by means of inserted sheet-metal elements.

The German Disclosure OS No. 2,557,072 describes an anchor in which the extremity of the strand is being upset in such a way as to produce a twin-cone-shaped enlargement made out of fanned-out stranded wires. This anchor resembles the bulb-type anchoring described above. The required projection of the strand downstream of the twin-cone-shaped enlargement is reduced by the applying of counter-bending onto the fanned-out stranded wires. A disadvantage of this anchoring is the comparatively substantial length of the "bellying" and of the projection of the strand at a given diameter of the enlargement. There exists also the danger that at the beginning of the bulge—where the entire or substantially the entire tension force is still present—the plastic deformation of the stranded wires is so intense that tensile and dynamic strengths are reduced excessively.

DISCUSSION OF THE INVENTION

It is the object of the invention to design a tie-anchor at a multiple-wire strand in such a way that, given a reduced feed length, the plastic deformation of the stranded wires is maintained within admissible tolerances at the critical points.

By plastically upsetting the strand at its anchor end in a pear-shaped manner, where the bending of the stranded wires at the onset of the enlargement is restricted, e.g., predetermined by a female curvature-forming die, the radius of curvature in this critical area can be kept sufficiently high.

Owing to the concrete set in the interior of the "pear-shaped" end, the shape of the anchor is preserved even upon subjecting of the strand to load. The pulling out of the individual stranded wires is prevented in that the wires are subjected at the widest point of the "pear" to a hook-like deflection, preferably in such a way that the inwardly bent terminal sections of the wires are situated substantially in a transverse plane to the axis of the strand. Owing to the deflection there are generated bearing pressure forces oriented substantially in the direction of the angle bisector of the hook-shaped deflection, which supply simultaneously the contact pressure required for friction contact. The anchoring of the individual stranded wire is therefore brought about by means of a particularly advantageous combination of penetration tensions, friction, and by deflection forces. As a result, it becomes possible to have a short development length with low cleavage-causing tractive forces. The concrete within the "pear-shaped end" is capable of absorbing this stress in view of the fact that the bearing pressures are oriented concentrically inwardly and generate a state of spatial compressive stress in the interior of the concrete "pear" formed therein. Since the radius of curvature of the stranded wires can be kept large at the onset of the enlargement, where the complete or substantially complete tensional force does still exist in the stranded wire, the bearing capacity of the stranded wire is only insignificantly affected by the deformation of the wires. It is true that the stranded wires are markedly deformed at the hook-like bend, however, at this point, a portion of the tensional force has already been transferred to the concrete due to the deflection present at the onset of the enlargement. The stress on the stranded wires is therefore smaller so that any potential impairment of the mechanical properties in this area does not affect the overall carrying capacity of the anchor tie. Due to the flat head crosswise to the axis of the stranded wire, one avoids the presence of projecting lengths. A tie-anchor in accordance with the invention is short. As a result, the entire transfer length can likewise be kept short.

This invention creates furthermore a process for the manufacture of a tie-anchor in accordance with the invention. As a result of the fact that, initially, there takes place the secure clamping of the stranded wire accompanied by a simultaneous restricting of the wire bending to a minimum radius, one guarantees that, at the onset of the upsetting pressure, all even the inwardly situated wires of the strand are, for spreading purposes, securely held and are initially restricted to a limited deflection. Advantageous additional process steps, as well as characteristics of a device suitable for carrying the process into effect, will be readily disceived from a reading of the following:

The device in accordance with the invention for the manufacture of the anchor consists preferably of a frame having at one side a mounting support for a stranded wire, provided with a female bending die, and, at the other side, an upsetting device—preferably a hydraulic press—with an upsetting plate. The mounting support for the stranded wire is designed in such a way that the clamping pressure is applied independently of the upsetting force. This arrangement guarantees that the stranded wire is securely held during the upsetting process. The clamping force can be adjusted in such a way as to lock in securely not only the outside wires under external forces, but even the core wires that are maximally jeopardized.

Whereas, in the case of a clamping-key, outfitted mounting support for stranded wires known in the art, in which the magnitude of the clamping force is a function of the upsetting or unravelling force, there exists the risk, in particular at the onset of the upsetting process, that the clamping force will be inadequate to hold the stranded wire, one does, in accordance with this invention, prevent any slipping through in that, prior to the onset of the upsetting or unravelling process, the required clamping force is applied by means of a hydraulically actuated vise. The clamping jaws are provided at the anchor-side extremity with a female bending die designed to limit the radius of curvature of the stranded wires.

The diameter of the upsetting plate is at least as large as the intented enlargement of the strand. The upsetting plate is provided in its center with a borehole whose diameter is two to four times, preferably twice, as large as the diameter of the strand. The bore-hole is only about as deep as the diameter of an individual stranded wire. This borehole serves for bracing the stranded wire during the upsetting process. Once the strand has been locked in the mounting support and the upsetting process is initiated, the individual stranded wires will buckle. The stranded wires will no longer run into the borehole perpendicular to the upsetting plate. As a result, at the extremities of the stranded wires there arise forces that are parallel to the upsetting plate. With increasing buckling, the frictional forces are eventually overcome and the stranded wires slide against the edge of the borehole. Against this point they are being braced until they apply against the opposite edge of the borehole and, upon continued compressing of the strand, are eventually removed, lever-like, out of the borehole. As long as the stranded wires abut against the edge of the borehole, they are capable of absorbing comparatively large forces parallel to the upsetting plate. These forces are required for the enlargement of the expansion. It is only at the moment when the stranded wires have been forced out of the borehole that all that does still exist is frictional contact between the stranded wires and the upsetting plate. Now, the wires are positioned practically parallel to the upsetting plate so that, upon further compressing, the stranded wires can no longer slip away. As a result of the coordinated relationship of the diameter of the bore, the depth of the bore, and the size of the plate, one achieves that stranded wires are directed, that they do not prematurely slip away from the upsetting plate, and that no counter-bending is imparted upon them. The premature slipping off of the stranded wires 2 would prevent the deformation in the shape of a pear. A counter-bending at the extremities of the stranded wires would also result in an extension of the tie-anchor.

According to a preferred embodiment there are being provided two concentric boreholes in which the diameters of the boreholes amount with the smaller one to approximately twice the diameter of the stranded wire and, with the larger one, to three to five times the diameter of the stranded wire. Each step of the two boreholes is substantially as deep as the thickness of one individual stranded wire. With this design one achieves a more uniform bent shape of the individual wires.

The core wire that is clamped within the outside wires is subject frequently jumping out of the borehole prematurely. It is then intercepted at the edge of the larger borehole. The other wires slip out of the deeper borehole earlier than in the case of a single-step borehole and are likewise intercepted at the edge of the larger borehole. All wires remain at the edge of the larger borehole for a period of time until they are lifted out of the borehole, lever-like, substantially simultaneously.

DESCRIPTION OF THE DRAWINGS

The invention is described below by way of example with reference to the drawings, in which.

DESCRIPTION OF PREFERRED EMBODIMENT

Figure 1:
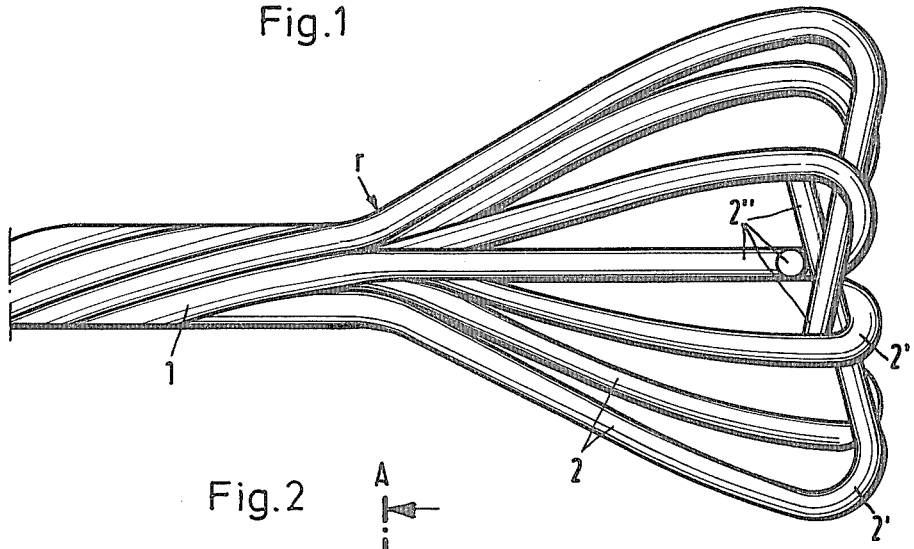
FIG. 1 shows a tie-anchor, according to the invention, at a strand or cable consisting of a plurality of wires.

FIG. 1 shows a strand or cable 1 provided at its extremity with an anchor in accordance with the invention. The enlargement of the cable or strand diameter is chosen in such as way that the individual stranded wire 2 are plastically bent so that they can no longer return into their original state. The ratio of the diameter of the enlarged portion to the unenlarged portion is between about 4:1 to 10:1. Moreover, the reciprocal spacing of the buckled standed wires must be so large that its inner space can be filled with concrete. At the beginning of forming the anchor, the stranded wires 2 are bent at a large radius of curvature. The radius of curvature r is defined by a female die as described below in greater detail. At the widest point of the anchor, the stranded wires are inwardly bent necessarily at a sharp curvature by more than 90° and from a substantially flat head of the anchor perpendicular to the axis of the strand 1.

Figure 2:
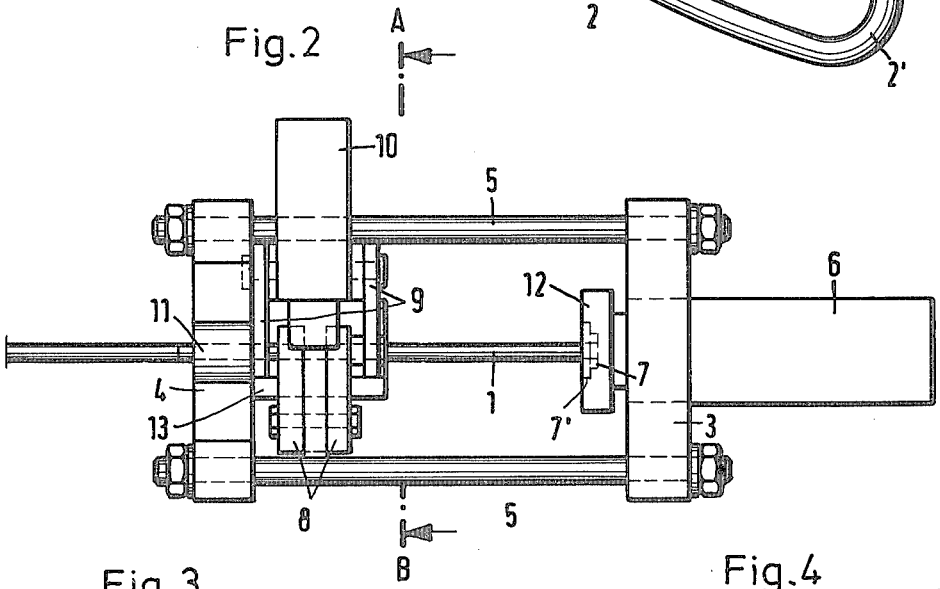
FIG. 2 illustrates schematically an elevation of a device for the manufacture of an anchor according to FIG. 1.

The device illustrated in FIG. 2 is made up of two cross-pieces 3 and 4 interconnected by the tie rods 5. To one cross-piece 3 there has been mounted a hydraulic press 6 serving for the upsetting or unravelling of the cable wires. An upsetting plate 12 is detachably mounted to the piston of the upsetting press 6. In the center of the upsetting plate there is the twin-step borehole 7,7', described above, and disposed to accommodate the wires 2. The other cross-piece 4 serves as a base for the strand-mounting support.

Figure 3:
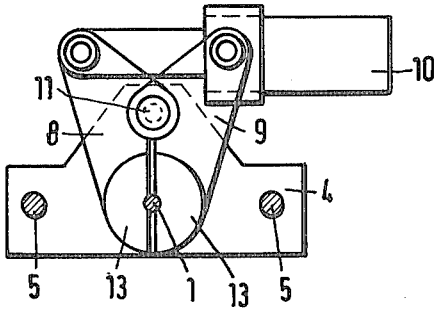
FIG. 3 shows the section A-B of FIG. 2 with a view of the hydraulic clamping claw in its closed state.

The strand-mounting support is illustrated in FIG. 3. The strand 1 is held by means of a clamp. Two clamping claw halves 8, 9 are mounted to the piston or cylinder, respectively, of a hydraulic press 10. If the piston of the press 10 is extended, the clamping jaws 13 move around the shaft 11 and tightly clamp the strand or cable 1. The clamping force can be controlled by hydraulic pressure. The strand-mounting support is detachably connected with the cross-piece 4 by means of a knockout spindle 11. It is only after the strand or cable 1 has been rightly clamped that the piston of the upsetting press 6 is extended and upsets the strand so as to cause the buckling of the individual stranded wires, while their extremities are supported in the borehole 7,7'.

Figure 4:
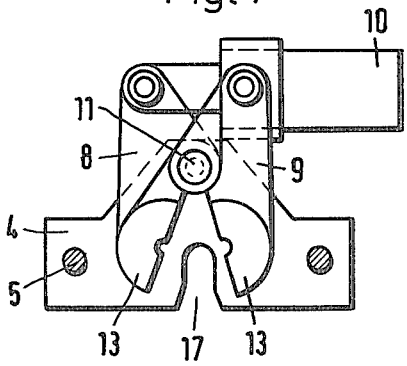
FIG. 4 shows the section A-B of FIG. 2 with the hydraulic clamping claw in its open state.

FIG. 4 illustrates the clamping claw in its open state. The pistons of the press 10 has been retracted and has opened the clamping jaws 13. In FIG. 4 there can also be seen a slot 17 in the cross-piece 4. By means of said slot the device can be inverted over the strand and, following the strand unravelling to form the shape of the "pear", the device can also be lifted off again. The slot 17 is only slightly wider than the thickness of the strand so that the clamping jaws 13 can find an adequate bearing surface on the cross-piece 4.

Figure 5:
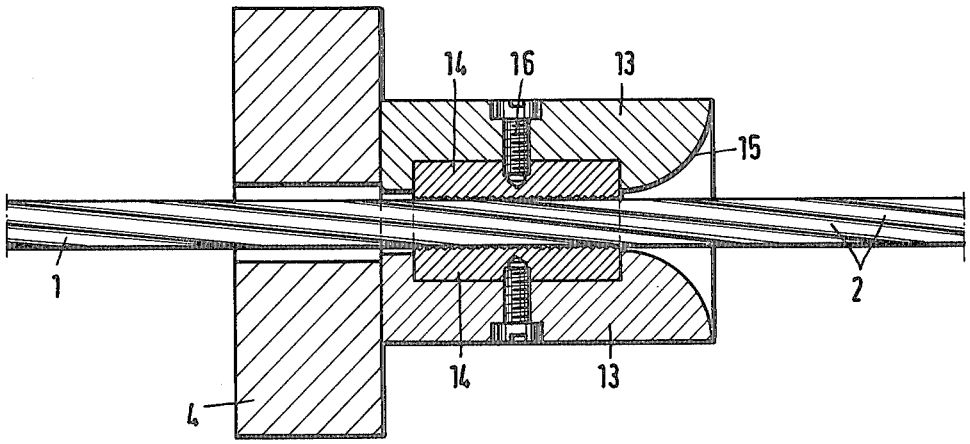
FIG. 5 illustrates on an enlarged scale an axial section through the clamping jaws of the hydraulic claw and through the bending die.

FIG. 5 shows a section through the clamping jaws 13. It is advantageous if the areas that come in contact with the strand are provided with friction-enhancing means. In view of the fact that these means become worn as a result of frequent clamping, it is recommended to design the parts that are subject to wear to be replaceable, for instance in the form of individual clamping elements 14 made of carburized steel and provided with a friction-causing surface. The clamping elements 14 are fastened to the clamping jaw 13 by means of screws 16. The outlet side of the clamping jaws facing the upsetting die is rounded off in the shape of a funnel. The rounded-off section 15 serves as a female bending die and prevents the formation of an insufficiently large radius of curvature of the stranded wires.

Figure 6:
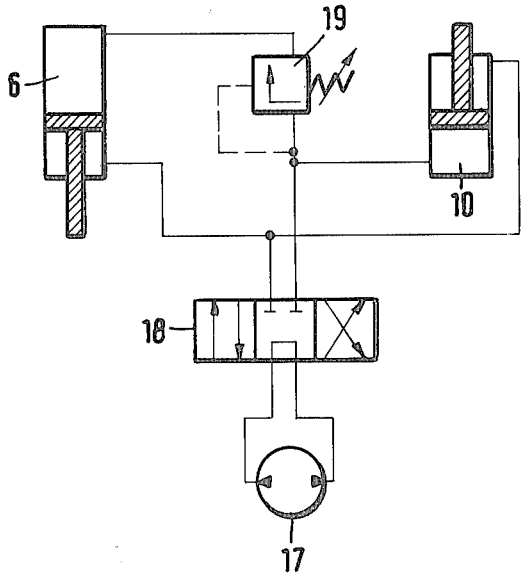
FIG. 6 illustrates a hydraulic circuit for the device.

FIG. 6 illustrates a preferred hydraulic circuit for the device. By actuating a change-over valve 18, pressure is being built up down-stream of a valve 19. The piston of the cylinder 10 for the clamp is driven out and closes the clamping jaws 13. After achieving the clamping pressure predetermined at the valve 19, oil flows into the upsetting cylinder 6. The upsetting piston is driven out and causes the upsetting at the strand in the shape of a pear. Meanwhile, the oil pressure in the clamp-actuating cylinder 10 remains constant. Onto the piston in the upsetting cylinder 6 there is applied the differential pressure resulting from the pressure at pump 17 and the pressure in the clamp-actuating cylinder 10. This guarantees that the strand is maintained at a constant clamping force throughout the upsetting process. The clamping force can be adjusted in such a way that, on the one hand, the strand is securely held and, on the other, the strand is not damaged by the clamping jaws. Once the upsetting process has been terminated, the valve 18 is reversed and oil is fed into the return chambers of the cylinders 6 and 10. The pistons return into their rest position and the clamping claw is opened. No pressure biassing is brought about in the process within the valve 19 in view of the fact that the returning oil can drain off free from any pressure.

What is claimed is:

1. A tie-anchor for a reinforcing cable comprising, a plurality of steel wires, a first portion being entwined, a second portion being untwined with the wires being radially outwardly disposed, said second portion having a pear-shaped configuration for subsequently filling with concrete, a third portion wherein the wires are bent so as to be entwined substantially in a first plane, and wherein the free ends of the bent wires being substantially in a second plane adjacent the first plane, said free ends being outwardly facingly disposed away from each other.

2. The tie-anchor of claim 1, wherein the second portion is formed at one end of the cable.

3. The tie-anchor of claim 1, wherein one end of the pear-shaped configuration is substantially flat.

4. The tie-anchor of claim 3, wherein the flat end is pependicular to the axis of the first portion of the cable.

5. The tie-anchor of claim 1, wherein the ratio of the widest second portion diameter to the first portion diameter is from about 4:1 to 10:1.

6. A tie-anchor for a reinforcing cable comprising a plurality of steel wires, said wires being plastically deformably spread through spreading accompanied by plastic deformation of the wires, the ratio of the diameter of the portion of the cable with the spread wires to the diameter of the portion with unspread wires being between 4:1 and 10:1, wherein the spread wires comprise a substantially pear-shaped configuration in which the wires are spaced from each other so as to permit the space formed between the wires to be subsequently filled with concrete so as to be therewithin, in which the wires are bent in the starting portion of the tie-anchor adjacent the portion where the wires have not been spread apart with a radius of curvature not remaining under a predetermined minimum value, in which a terminal portion is formed by a hook-like inward bending of the spread wires reversed towards the starting portion with the ends of the wires being outwardly facedly disposed, said inward bent spread wires being situated substantially in a plane crosswise to the axis of the strand and being brought together at the axis of the strand, said radius of curvature being formed at the starting portion.

* * * * *